US010751849B2

(12) United States Patent
Rossetti et al.

(10) Patent No.: US 10,751,849 B2
(45) Date of Patent: Aug. 25, 2020

(54) GRINDING TOOL

(71) Applicant: Tyrolit-Schleifmittelwerke Swarovski K.G., Schwaz (AT)

(72) Inventors: Thomas Rossetti, Wattens (AT); Ralf Palmetshofer, Neuzeug (AT); Mario Nairz, Vomp (AT)

(73) Assignee: TYROLIT—SCHLEIFMITTELWERKE SWAROVSKI K.G., Schwaz (AT)

( * ) Notice: Subject to any disclaimer, the term of this patent is extended or adjusted under 35 U.S.C. 154(b) by 546 days.

(21) Appl. No.: 15/130,106

(22) Filed: Apr. 15, 2016

(65) Prior Publication Data

US 2016/0303700 A1 Oct. 20, 2016

(30) Foreign Application Priority Data

Apr. 20, 2015 (AU) ..... A 50309/2015

(51) Int. Cl.

| | |
|---|---|
| ***B24B 5/08*** | (2006.01) |
| ***B24B 5/06*** | (2006.01) |
| ***B24B 33/08*** | (2006.01) |
| ***B24B 33/02*** | (2006.01) |

(52) U.S. Cl.

CPC ..... *B24B 5/06* (2013.01); *B24B 5/08* (2013.01); *B24B 33/02* (2013.01); *B24B 33/025* (2013.01); *B24B 33/083* (2013.01)

(58) Field of Classification Search

CPC .... B24B 5/06; B24B 5/08; B24B 5/10; B24B 5/14; B24B 33/02; B24B 33/025; B24B 33/083

USPC ..... 451/51, 120, 449

See application file for complete search history.

(56) References Cited

U.S. PATENT DOCUMENTS 2,277,985 A * 3/1942 Jeschke ..... B24B 33/08 451/151
2,284,325 A * 5/1942 Kline ..... B24B 33/06 451/151
2,412,419 A * 12/1946 Palotsee ..... B24B 33/08 451/476

(Continued)

FOREIGN PATENT DOCUMENTS

DE 24 62 847 5/1986
DE 10 2006 025 582 12/2007

(Continued)

OTHER PUBLICATIONS

Extended European Search Report dated Dec. 6, 2016 in corresponding European Application No. 16 16 2638 with English translation.

(Continued)

*Primary Examiner* — Eileen P Morgan

(74) *Attorney, Agent, or Firm* — Wenderoth, Lind & Ponack, L.L.P.

(57) ABSTRACT

A grinding tool for machining an inside surface of a cylinder bore in a workpiece, the grinding tool having an axis of rotation, a grinding region which is cylindrical with respect to the axis of rotation and a conical grinding region axially adjoining the cylindrical grinding region. A diameter of the conical grinding region increases starting from the cylindrical grinding region in an axial direction with respect to a diameter of the cylindrical grinding region.

15 Claims, 8 Drawing Sheets

(56) References Cited

U.S. PATENT DOCUMENTS 2,438,239 A * 3/1948 Toulmin, Jr. ..... B24B 11/08 451/50
3,496,678 A * 2/1970 Engle ..... B24B 33/083 451/124
4,187,644 A * 2/1980 Fitzpatrick ..... B24B 33/02 451/151
4,194,323 A * 3/1980 Blocker, Jr. ..... B24B 5/26 451/242
4,907,372 A * 3/1990 Molitor ..... B24B 33/02 451/130
4,934,040 A * 6/1990 Turchan ..... B23Q 5/40 29/566
5,085,014 A * 2/1992 Sandhof ..... B24B 33/08 451/463
5,095,662 A * 3/1992 Grimm ..... B24B 33/06 451/10
5,177,904 A * 1/1993 Nagel ..... B24B 33/06 451/156
5,305,556 A * 4/1994 Kopp ..... B06B 3/00 451/124
5,371,978 A * 12/1994 Higashikawa ..... B24B 33/02 451/155
5,800,252 A * 9/1998 Hyatt ..... B24B 33/105 451/164
6,074,282 A * 6/2000 Schimweg ..... B24B 33/04 451/119
6,527,620 B1 * 3/2003 Moellenberg, Jr. ... B24B 33/027 451/464
6,638,139 B2 * 10/2003 Carlson, III ..... B23B 5/02 451/247
2002/0115391 A1 * 8/2002 Yamaguchi ..... B24B 5/22 451/49
2002/0173236 A1 * 11/2002 Weigmann ..... B24B 19/028 451/27
2003/0129928 A1 * 7/2003 Moellenberg, Jr. ... B24B 33/027 451/51
2010/0240284 A1 * 9/2010 Lin ..... B24B 33/02 451/51
2012/0051857 A1 3/2012 Stephenson
2012/0208436 A1 * 8/2012 Muller ..... B23F 19/00 451/5
2015/0360347 A1 * 12/2015 Mueller ..... B24D 5/02 451/49
2016/0354893 A1 * 12/2016 Baumgartner ..... B24B 33/083
2017/0129070 A1 * 5/2017 Flores ..... B24B 33/04
2018/0318979 A1 * 11/2018 Wagner ..... B23B 41/06

FOREIGN PATENT DOCUMENTS

DE 20 2010 010 740 11/2011
DE 10 2011 081 085 3/2012
WO 2006/091169 8/2006
WO 2013/114527 8/2013

OTHER PUBLICATIONS

Austrian Search Report dated Jan. 29, 2016 in corresponding Austrian Patent Application No. A 50309/2015 with English translation.

* cited by examiner

GRINDING TOOL

BACKGROUND OF THE INVENTION

1. Field of the Invention

The invention concerns a grinding tool, a set comprising a first grinding tool and a second grinding tool, a grinding tool for a set according to the invention as a second grinding tool, the use of a grinding tool according to the invention or one of the two grinding tools of the set according to the invention in a machining process for the inside surface of a cylinder bore in a workpiece, and a CNC machine having at least one grinding tool according to the invention or at least one of the two grinding tools of the set according to the invention and a control program adapted to carry out the machining process in automated fashion.

2. Description of the Related Art

It has been found that the cylinders in internal combustion engines, in the operating condition, are deformed by virtue of a spatially irregular rise in temperature, in such a way that in the operating condition there is a shape departing from the ideally cylindrical shape. That results in an increased fuel consumption, which is problematical in view of the limit values to be observed in regard to the emission of the amount of $CO_2$ per kilometer.

To resolve that problem, a honing process was developed, the aim of which is not the cylindrical shape of the bore but which already takes account of the distortions to be expected, in terms of production engineering, so that virtually cylindrical bore peripheral surfaces occur under operating conditions. In that way it becomes possible to reduce the piston ring stress. The consequences are lower friction, a lower fuel requirement and thus a reduced $CO_2$ emission.

A disadvantage with that honing process however is that it involves a relatively large amount of time as the honing tool has to be reciprocated in an oscillating movement in the cylinder bore. In addition it would be desirable to still further improve the precision in relation to that process.

SUMMARY OF THE INVENTION

The object of the present invention is therefore that of providing a grinding tool or a set comprising a first and a second grinding tool which makes it possible to machine the inside surface of a cylinder bore in a workpiece very quickly and with a high degree of precision, to such an effect that after the machining operation the inside surface is of a shape which under operating conditions changes into a quasi-cylindrical shape. A further object of the invention is to provide a use of a grinding tool in a machining process for the inside surface of a cylinder bore in a workpiece, as well as a CNC machine having at least one grinding tool according to the invention.

In regard to the grinding tool according to the invention it is therefore provided that the grinding tool has a grinding region which is cylindrical with respect to the axis of rotation and a conical grinding region axially adjoining the cylindrical grinding region and the diameter of the conical grinding region increases starting from the cylindrical grinding region in the axial direction with respect to the diameter of the cylindrical grinding region.

A process for machining the inside surface of a cylinder bore in a workpiece, for example an engine block, could thus be such that the grinding tool is introduced with its cylindrical grinding region and its adjoining conical grinding region into the cylinder bore, it is moved to the inside surface of the cylinder bore, it is guided at least once in a circle along the inside surface of the cylinder bore, in which case it rotates about its axis of rotation, it is lifted off the inside surface of the cylinder bore and is moved out of the cylinder bore again. Accordingly, subsequently to the machining process, the inside surface of the cylinder bore has adopted a form which is firstly cylindrical and, where the conical grinding region became operative, it is in the form of an opening cone. If now a cylinder bore machined in that way expands irregularly by virtue of the fact that a greater amount of heat is generated in the cylindrical region than in the region of the opening of the cone, a quasi-cylindrical bore peripheral surface occurs.

Because the cylinder bore can be machined in one single working operation by means of the grinding tool the time required for the machining operation is reduced. In addition the precision in shaping is increased as, during the machining process, the grinding tool does not have to be reciprocated in the direction of the depth of the cylinder bore as is the case with honing tools.

In regard to the set according to the invention it is provided that the first grinding tool has a grinding region which is cylindrical with respect to the axis of rotation and which is of a diameter and the second grinding tool has a grinding region which is conical with respect to the axis of rotation, wherein the diameter of the conical grinding region increases in the axial direction starting from a smallest diameter which corresponds to the diameter of the cylindrical grinding region of the first grinding tool.

In the case of the set a machining process for the inside surface of a cylinder bore in a workpiece, for example an engine block, could be such that firstly the second grinding tool with the conical grinding region is introduced into the cylinder bore, moved to the inside surface of the cylinder bore, guided at least once in a circle along the inside surface of the cylinder bore, in which case it rotates about its axis of rotation, is lifted off the inside surface of the cylinder bore and is moved out of the cylinder bore again. In a subsequent step the first grinding tool is introduced with the cylindrical grinding region into the cylinder bore, moved to the inside surface of the cylinder bore, guided at least once in a circle along the inside surface of the cylinder bore, in which case it rotates about its axis of rotation, lifted off the inside surface of the cylinder bore and moved out of the cylinder bore again. As a result, following the machining process, the inside surface of the cylinder bore has assumed a shape which is initially cylindrical and, where the conical grinding region became effective, is in the form of an opening cone. If now a cylinder bore machined in that way expands irregularly by virtue of a greater amount of heat being generated in the cylindrical region than in the region of the opening of the cone a quasi-cylindrical bore peripheral surface occurs.

The two machining steps by means of the first and the second grinding tools could also be carried out in the reverse sequence.

The variant involving machining of the inside surface of a cylinder bore by means of the set, in comparison with the variant involving machining of the inside surface of a cylinder bore by means of the grinding tool which has both the cylindrical grinding portion and also the conical grinding portion, admittedly has the disadvantage that two machining steps are necessary, but those two machining steps can be carried out with a lower level of drive force as a smaller grinding surface is operative per machining step.

It should be noted in particular that in accordance with a particularly preferred embodiment of the grinding tool according to the invention or the set according to the invention it is provided that the diameter of the conical grinding region increases in the axial direction over the length of the conical grinding region with respect to the diameter of the cylindrical grinding region by between 50 and 110 μm, preferably by 80 μm, that is to say the conical shape is not perceptible with the naked eye. Nonetheless, the desired technical effect already advantageously occurs in the machining of the inside surface of a cylinder bore.

The taper angle of the conical grinding region—measured with respect to an axis parallel to the axis of rotation—is preferably between 0.014° and 0.039°, particularly preferably 0.025°.

In addition it should be noted that it can be provided that the cylindrical grinding region and the conical grinding region are coated uniformly with the same grinding agent, preferably CBN. It is desirable in that case therefore that the two grinding regions give rise to substantially the same grinding effect. In this connection it should be noted that the coating with the grinding agent is desirably produced galvanically.

Embodiments defined herein permit highly efficient cooling of the grinding tool or tools, which also contributes to the fact that the inside surface of the cylinder bore can be machined with a very high level of precision.

A fundamental advantage of the grinding tool according to the invention or the grinding tools of the set according to the invention is also that the machined material is very rapidly removed from the grinding region.

Use of a grinding tool in a machining process for the inside surface of a cylinder bore in a workpiece is disclosed, wherein the grinding tool or the one of the two grinding tools of the set is introduced into the cylinder bore in the course of the machining process, moved against the inside surface of the cylinder bore, guided at least once in a circle along the inside surface of the cylinder bore, in which case it rotates about its axis of rotation, is lifted off the inside surface of the cylinder bore and is passed out of the cylinder bore again.

A CNC machine is disclosed which has at least one grinding tool according to the invention or at least one of the two grinding tools of the set according to the invention and a control program which is adapted to carry out the described machining process of the inside surface of a cylinder bore in a workpiece in automated fashion, that is to say to introduce at least one grinding tool or the at least one of the two grinding tools of the set into a cylinder bore in a workpiece, move it to the inside surface of the cylinder bore, guide it at least once in a circle along the inside surface of the cylinder bore, in which case it rotates about its axis of rotation, lift it off the inside surface of the cylinder bore and move it out of the cylinder bore again.

BRIEF DESCRIPTION OF THE DRAWINGS

Further details and advantages of the present invention are described more fully hereinafter by means of the specific description with reference to the drawings in which.

DETAILED DESCRIPTION OF THE INVENTION

Figure 1:
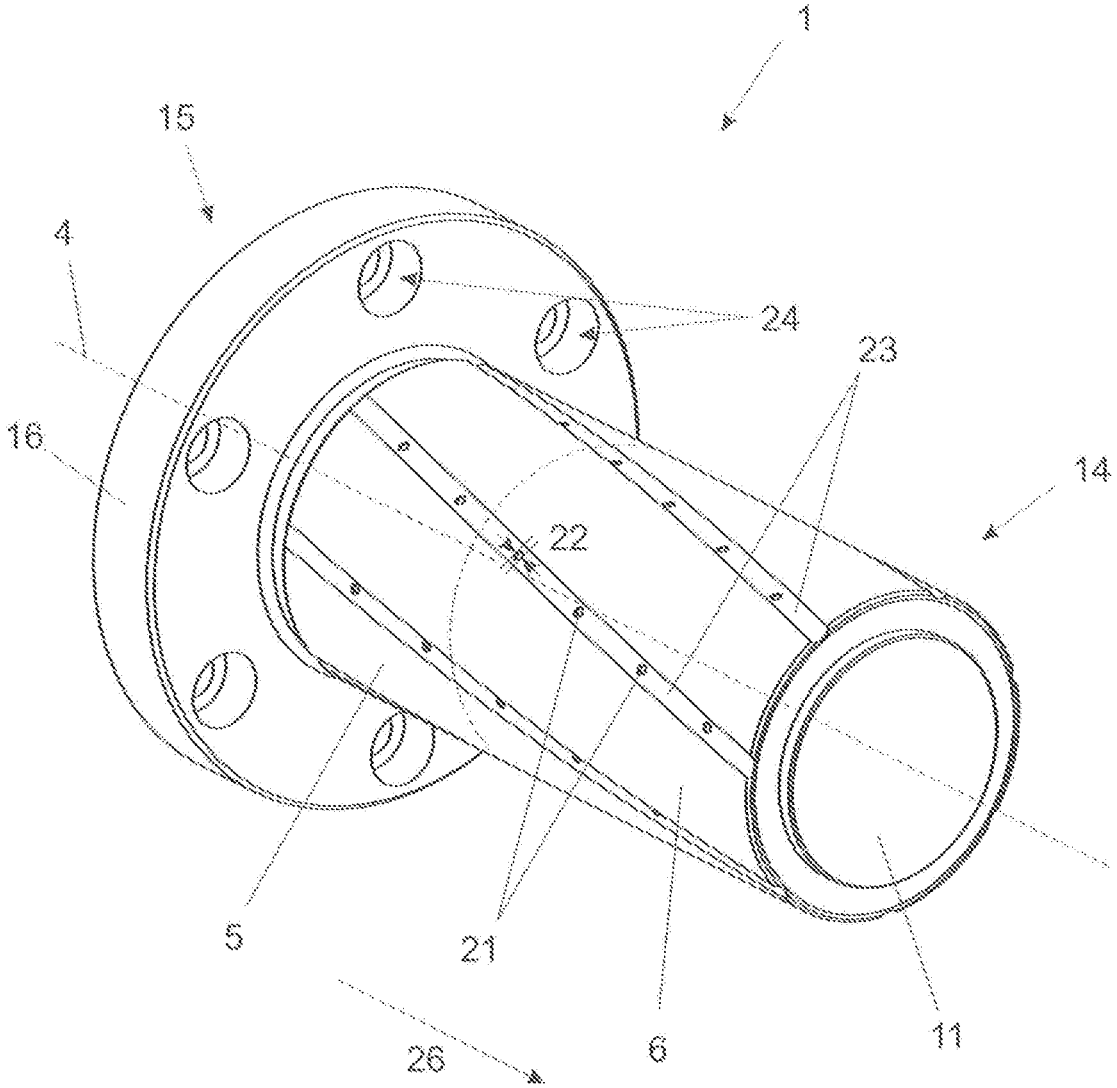
FIG. 1 shows a perspective view of the grinding tool according to a preferred embodiment.

FIG. 1 is a diagrammatic perspective view of the grinding tool 1 according to the invention in a preferred embodiment. It is of a substantially rotationally symmetrical configuration about an axis of rotation 4 extending in the longitudinal direction 26. The grinding tool 1 has a free end 14 and an opposite end 15 at which there is provided a fixing means 16 in the form of a flange for fixing the grinding tool 1 to a machining head of a CNC machine or an adaptor connected thereto (see FIG. 4). Provided in the fixing flange 16 are six openings 24 respectively displaced through 60° for receiving screws.

The grinding tool 1 has a main body 11 of steel which includes the fixing flange 16 and a component which projects therefrom and at the peripheral surface of which are arranged a grinding region 5 which is cylindrical with respect to the axis of rotation 4 and adjoining same a conical grinding region 6. In this case the cylindrical grinding region 5 is arranged adjacent to the fixing means 16 and the conical grinding region 6 is arranged adjacent to the free end 14 of the grinding tool 1. The transition between the cylindrical and the conical grinding regions 5 and 6 is indicated by means of a dotted line. The cylindrical grinding region 5 and the conical grinding region 6 are uniformly covered with the same grinding agent, namely CBN (cubic boron nitride). The coating is produced galvanically. Arranged in the working region are a total of seven grooves 23 which extend over the cylindrical grinding region 5 and the conical grinding region 6 and substantially in the longitudinal direction 26 of the grinding tool 1. Opening into those grooves 23 are passages 21 which are of a diameter of 2 mm. In total there are 42 such passages 21, the passages 21 being arranged in a spiral shape, more specifically such that each two adjacent passages 21 are rotated through an angle of 50° and are axially displaced by 3 mm.

Figure 2A:
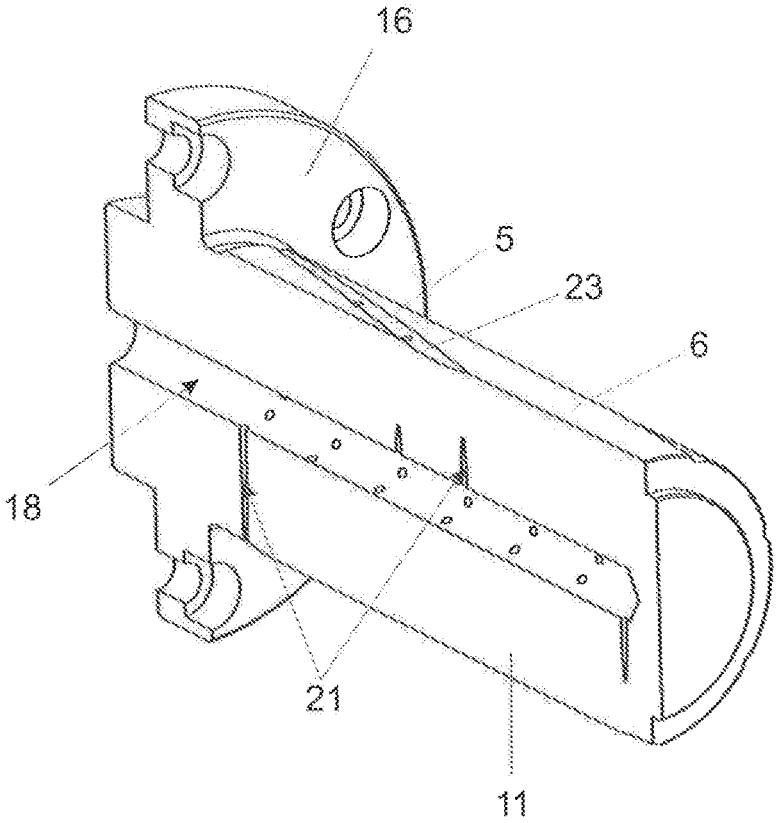
FIGS. 2A and 2B show a cross-sectional view of the grinding tool in the longitudinal direction.
Figure 2B:
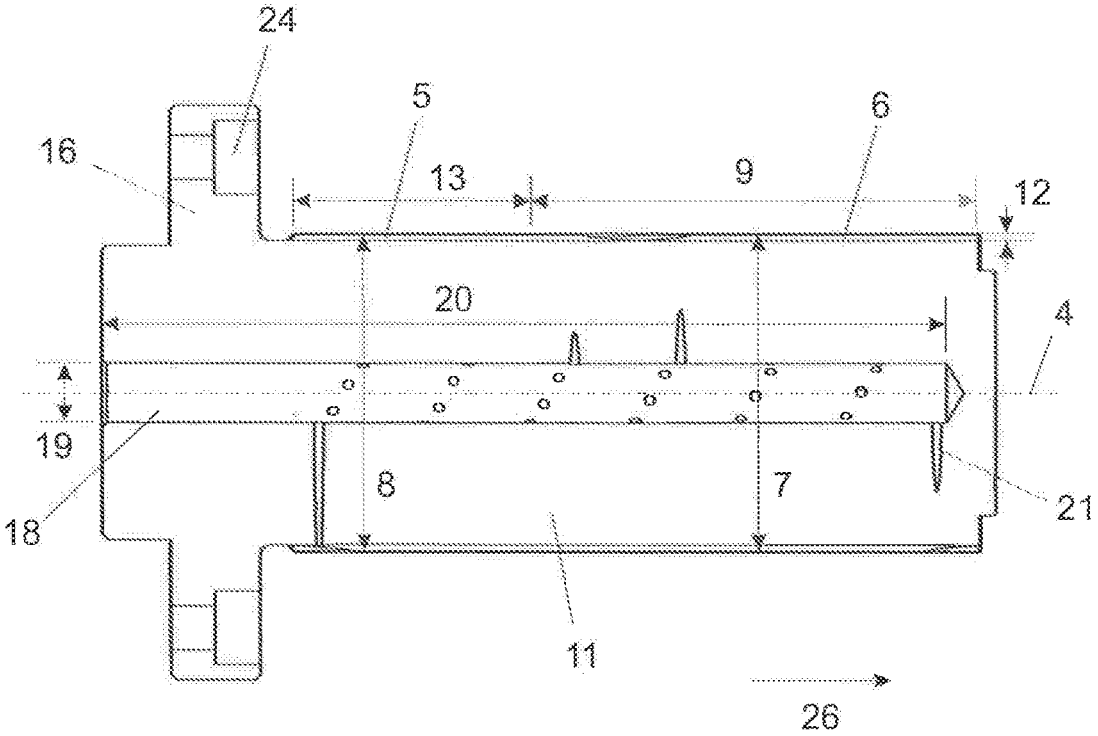

FIGS. 2A and 2B show cross-sectional views of the grinding tool along a central section plane parallel to the axis of rotation 4 or the longitudinal direction 26. In that respect FIG. 2A shows the section as a perspective view and FIG. 2B shows the same section viewed from a direction perpendicular to the cross-sectional plane.

It can be seen from these views that the grinding tool 1 further has a central bore 18 parallel to the axis of rotation 4, the bore 18 being of a diameter 19 of 12 mm and a length 20 of 170 mm. Extending between the bore 18 and the cylindrical grinding region 5 and the conical grinding region 6 are the passages 21 which, as already described, open into the grooves 23. The bore 18, the passages 21 and the grooves 23 overall form a coolant guide system which makes it possible for a centrally fed coolant to be efficiently passed on to the working region, that is to say the cylindrical grinding region 5 and the conical region 6, and to be distributed there.

In the specific embodiment shown by way of example the grinding tool 1 is of the following dimensions: the cylindrical grinding region 5 is of a diameter 8 of 65 mm. The diameter 7 of the conical grinding region 6 increases over the length 9 of the conical grinding region in the axial direction 26 by 80 μm with respect to the diameter 8 of the cylindrical grinding region 5. In that case the cylindrical grinding region 5 is of a length 13 of 50 mm and the conical grinding region 6 is of a length 9 of 90 mm. The thickness of the cylindrical and the conical grinding regions is 300 μm.

Those dimensions are respectively adapted to the workpiece to be ground (engine block). It is important in that respect that the overall length of the cylindrical and the conical grinding regions at least corresponds to the depth of the cylinder bore so that the grinding operation can be effected in one working step without the grinding tool having to be displaced in the direction of the depth of the cylinder bore during the machining process.

Figure 3:
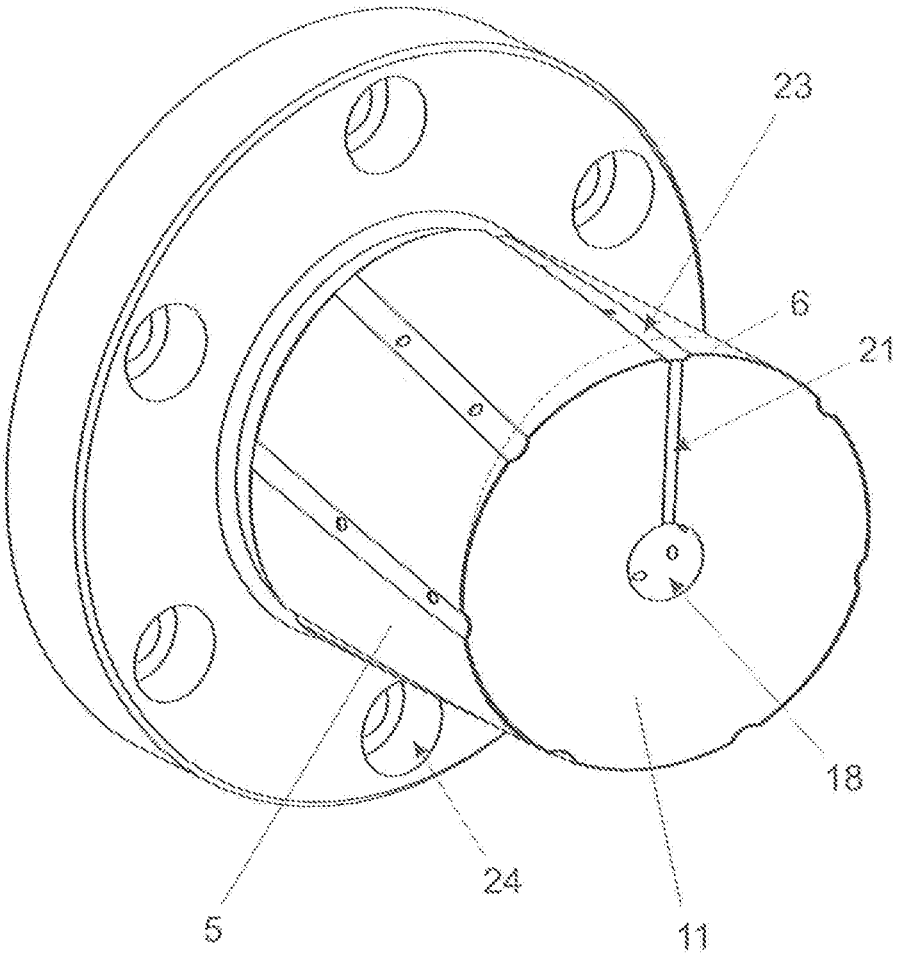
FIG. 3 shows a cross-sectional view through the conical grinding region of the grinding tool.

FIG. 3 shows a further cross-sectional view of the grinding tool 1 along a plane in which one of the passages 21 extends between the central bore 18 and one of the grooves 23.

Figure 4:
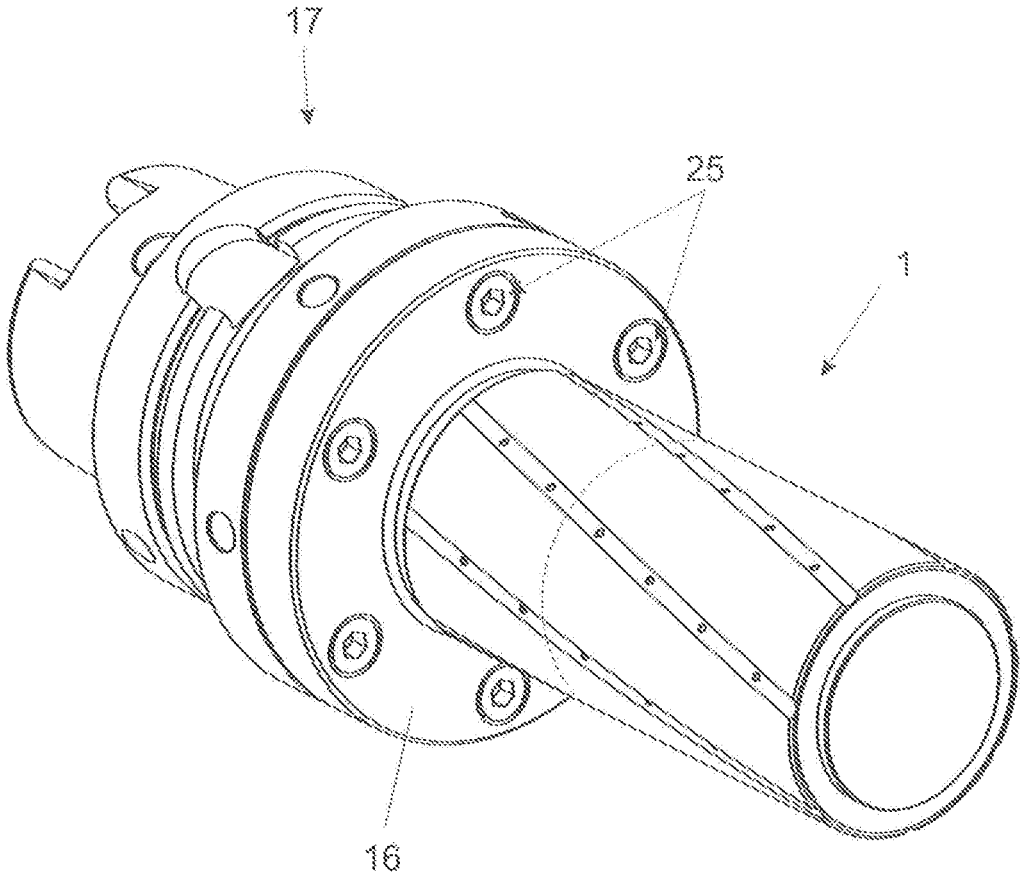
FIG. 4 shows the combination of the grinding tool and an HSK adaptor.

FIG. 4 shows the combination of a grinding tool 1 and a so-called HSK adaptor 17 which in a simple way makes it possible to fit the grinding tool 1 to a machining head of a CNC machine. The connection between the grinding tool 1 and the HSK adaptor 17 is made by way of six screws 25 which are disposed in the openings in the fixing flange 16 and which engage into threads on the adaptor 17. The CNC machine can be a usual three-axis machine.

Figure 5:
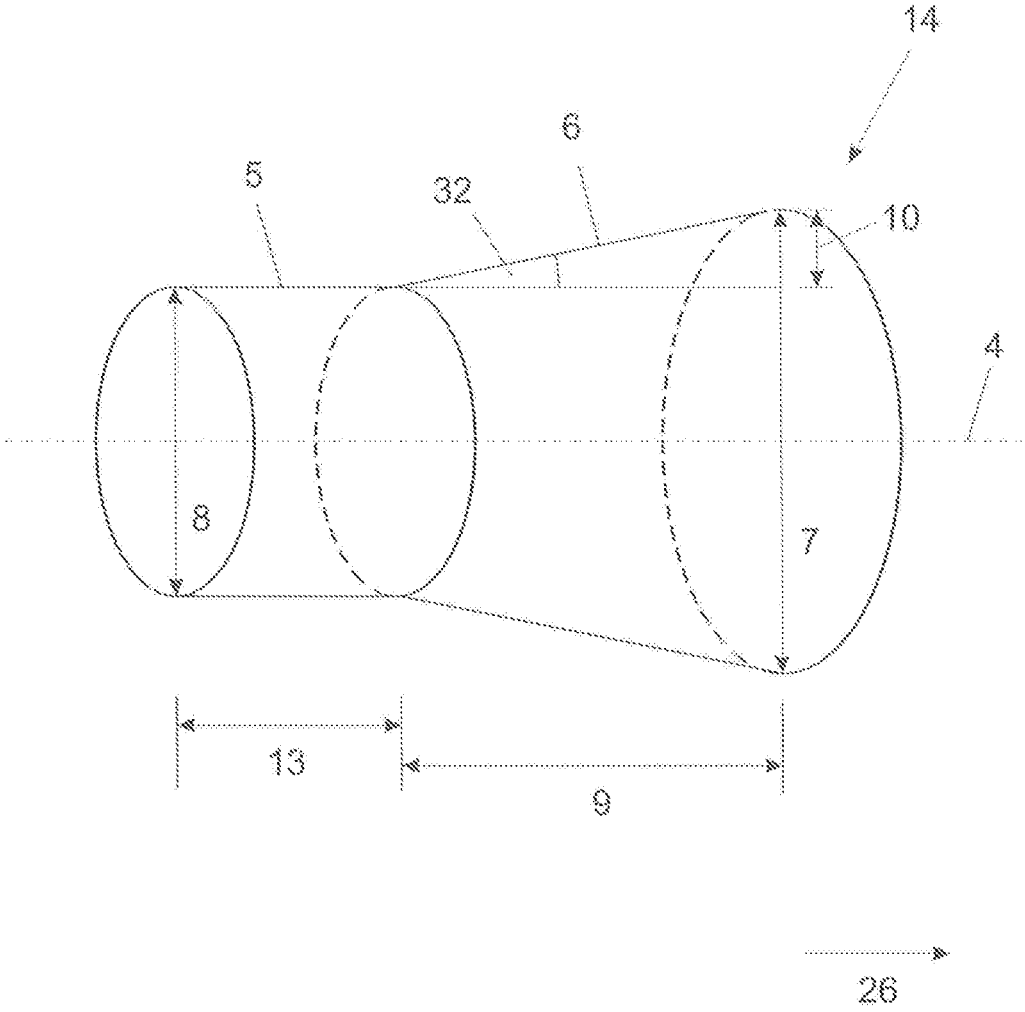
FIG. 5 is a view in principle to illustrate the cylindrical grinding region and an axially adjoining conical grinding region.

As the geometry of the cylindrical grinding region 5 and the adjoining conical grinding region 6 cannot be perceived with the naked eye on the grinding tool 1 according to the above-described embodiment that geometry is shown once again in exaggerated form to illustrate it in FIG. 5: the effective grinding region is composed of a cylindrical grinding region 5 of a length 13 and a diameter 8 and an adjoining conical grinding region 6 of a length 9 and a diameter 7 which, starting from the cylindrical grinding region 5, increases in the axial direction 26 with respect to the diameter 8 of the cylindrical grinding region 7. The overall increase in the diameter 7 of the conical grinding region 6 at the free end 14 corresponds to double the illustrated distance 10. The taper angle of the conical grinding region 6 is denoted by reference 32.

The sequence of FIGS. 6A through 6F serves to illustrate an advantageous machining process for the inside surface 2 of a cylinder bore 3 in a workpiece, for example an engine block. The views are each shown diagrammatically perpendicularly to the cylinder bore, more specifically from the side which is opposite the side from which the grinding tool 1, 27 or 28 (see FIGS. 7A, 7B, 8A and 8B) is introduced into the bore. The view if therefore on to the free end of the grinding tool 1, 27 or 28.

In a first step (transition from FIG. 6A to FIG. 6B) the grinding tool 1, 27 or 28 is introduced into the cylinder bore 3 substantially centrally and with the cylindrical and/or conical grinding region. The grinding tool 1, 27 or 28 is then moved to the inside surface 2 of the cylinder bore 3, as shown in FIG. 6C. After that the grinding tool 1, 27 or 28 is passed at least once in the circle along the inside surface 2 of the cylinder bore 3, in which case it rotates about its axis of rotation 4. It should be noted that the grinding tool 1, 27 or 28 can also already be caused to rotate prior to or after the actual grinding operation.

Figure 6A:
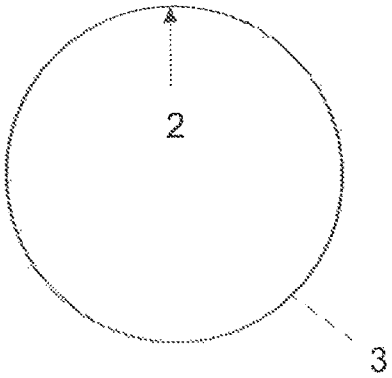
FIGS. 6A through 6F show diagrammatic views of the machining process for the inside surface of a cylinder bore in a workpiece by means of the grinding tool according to the invention.
Figure 6B:
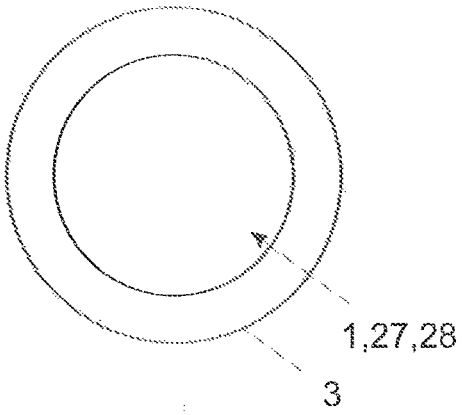
Figure 6D:
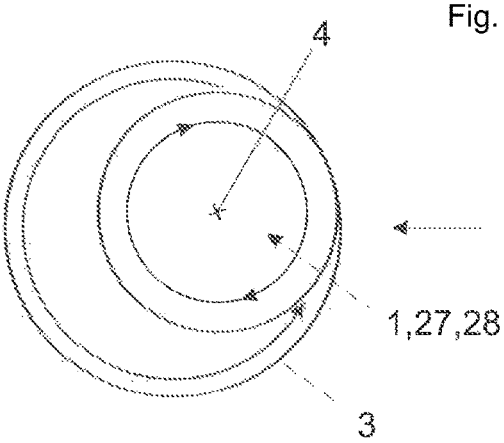
Figure 6C:
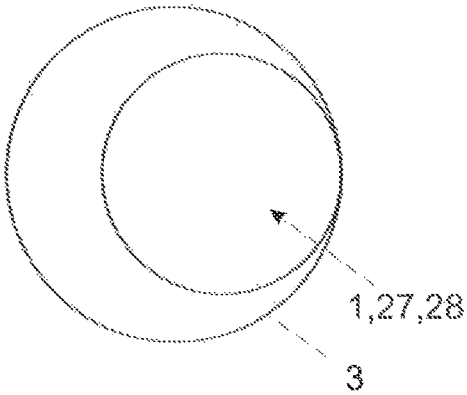
Figure 6E:
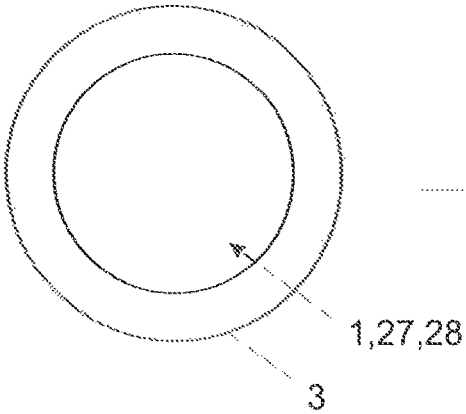
Figure 6F:
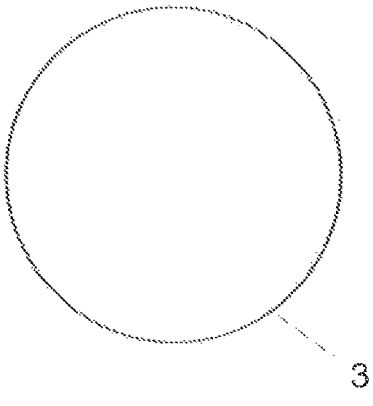

After the grinding operation has been effected the grinding tool 1, 27 or 28 is lifted off the inside surface 2 of the cylinder bore 3 again, that is to say it is moved into a substantially central position in relation to the cylinder bore 3 (see FIG. 6E) and finally passed out of the cylinder bore 3 again (transition between FIG. 6E and FIG. 6F).

FIG. 6D indicates by way of example by arrows a given direction of movement of the grinding tool 1, 27 or 28 along the inside surface 2 of the cylinder bore 3 and a given direction of rotation of the grinding tool 1, 27 or 28 about the axis of rotation 4. In principle both directions of rotation are possible for those respective movements.

In general it should also be noted that this machining operation in the case of metallic workpieces can be effected both directly at the untreated surface and also at a coated, for example AWS-coated, surface. In this case AWS stands for arc wire spraying which is a special coating process with a wire which is converted into the plasma phase.

Figure 7A:
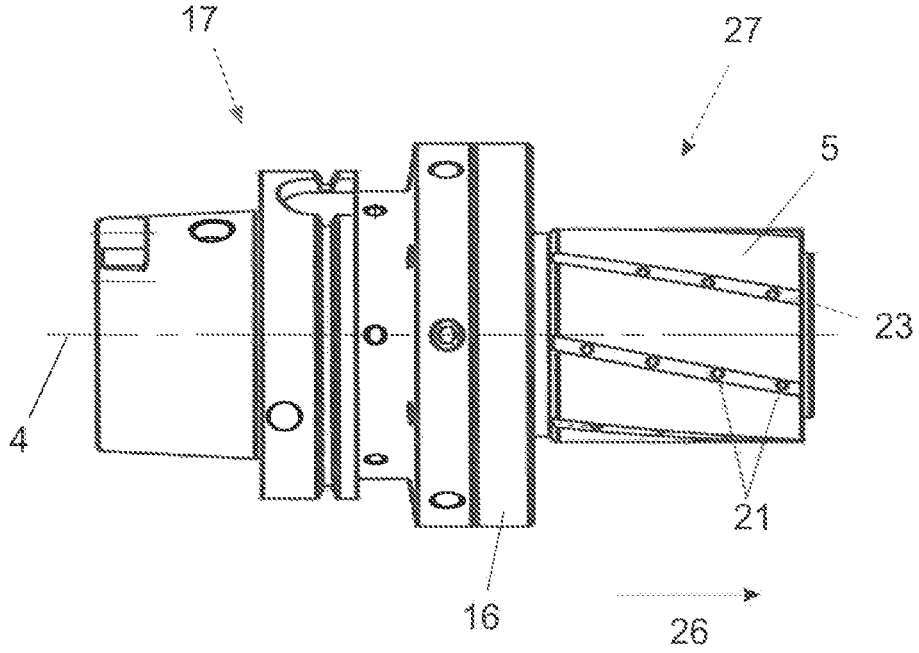
FIGS. 7A and 7B show the first grinding tool of the set according to the invention in a preferred embodiment, more specifically as a side view with adaptor (FIG. 7A) and as a cross-sectional view (FIG. 7B)
Figure 7B:
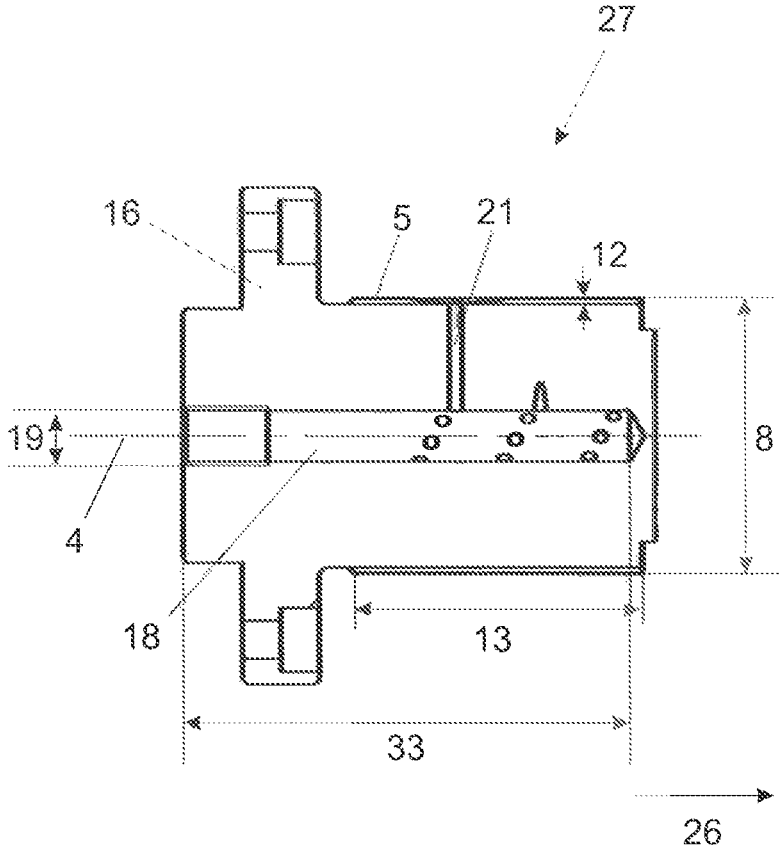
Figure 8A:
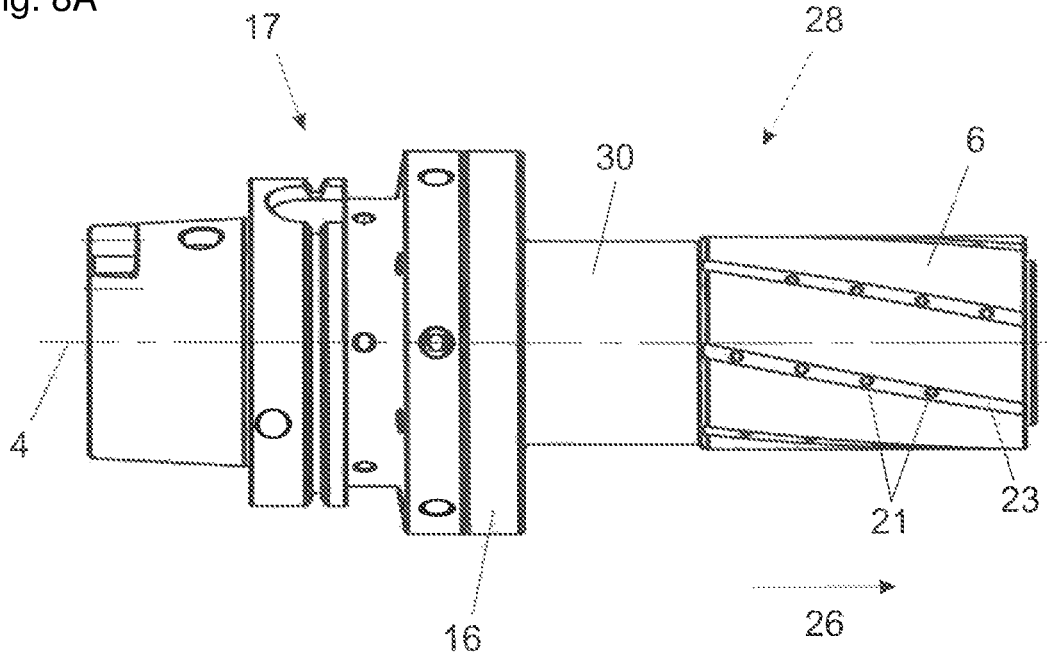
FIGS. 8A and 8B show the second grinding tool of the set according to the invention in a preferred embodiment, more specifically as a side view with adaptor (FIG. 8A) and as a cross-sectional view (FIG. 8B).
Figure 8B:
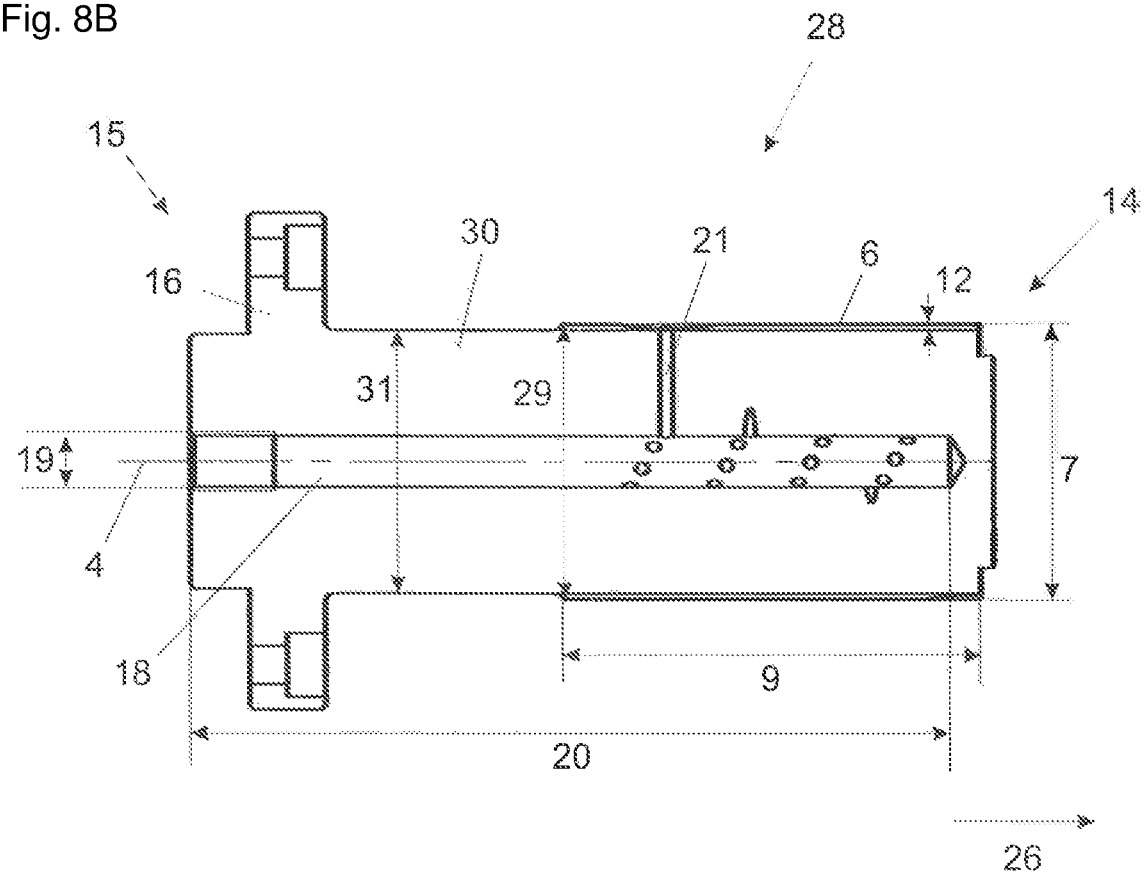

FIGS. 7A, 7B, 8A and 8B show advantageous embodiments of the set according to the invention, wherein FIGS. 7A and 7B show the first grinding tool 27 and FIGS. 8A and 8B show the second grinding tool 28—in FIGS. 7A and 8A in each case together with an adaptor 17 connected to a fixing means 16 in the form of a flange.

The first grinding tool 27 has a grinding region 5 which is cylindrical with respect to the axis of rotation 4 and is of a diameter 8.

The second grinding tool 28 has a grinding region 6 which is conical with respect to the axis of rotation 4, wherein the diameter 7 of the conical grinding region 6, starting from a smallest diameter 29 which corresponds to the diameter 8 of the cylindrical grinding region 5 of the first grinding tool 27, increases in the axial direction.

Besides same the second grinding tool 28 has a grinding agent-free region 30. That is of a configuration which is cylindrical with respect to the axis of rotation 4, of a diameter 31 which is reduced by 3 mm with respect to the smallest diameter 29 of the conical grinding region 6.

The length of the grinding agent-free region of the second grinding tool 28 corresponds to the length 13 of the cylindrical grinding region 5 of the first grinding tool 27.

The overall length of the second grinding tool 28 corresponds to the overall length of the grinding tool 1 which has both the cylindrical grinding region 5 and also the conical grinding region 6.

Both the first grinding tool 27 and also the second grinding tool 28 have a central bore 18 each extending approximately over the entire grinding tool 27 and 28 respectively. The length of the bore 18 is denoted by references 33 and 20 respectively.

As in the case of the grinding tool 1 which has both the cylindrical grinding region 5 and also the conical grinding region 6 the first grinding tool 27 and the second grinding tool 28 of the set have passages 21 extending between the central bore 18 and the cylindrical grinding region 5 and the conical grinding region 6 respectively. There are no such passages 21 provided in the grinding agent-free region 30 of the second grinding tool 28.

The invention claimed is:

1. A set comprising:

a first grinding tool; and a second grinding tool, wherein:

each of the first grinding tool and the second grinding tool is configured to machine an inside surface of a cylinder bore in a workpiece;

each of the first grinding tool and the second grinding tool has an axis of rotation;

the first grinding tool has a grinding region which is cylindrical with respect to the axis of rotation of the first grinding tool;

the second grinding tool has a grinding region which is conical with respect to the axis of rotation of the second grinding tool;

the first grinding tool and the second grinding tool are separate and distinct such that only one of the first grinding tool and the second grinding tool is configured to rotate at a time;

a diameter of the grinding region of the second grinding tool increases in an axial direction of the second grinding tool starting from a smallest diameter of the grinding region of the second grinding tool which corresponds to a diameter of the grinding region of the first grinding tool which is separate and distinct from the second grinding tool;

the second grinding tool has a free end and an opposite end, and the grinding region of the second grinding tool adjoins the free end on the second grinding tool;

the second grinding tool includes a flange configured to fix the second grinding tool to: (i) a machining head of a CNC machine; or (ii) an adaptor connected to the machining head of the CNC machine; and the flange is formed at the opposite end of the second grinding tool.

2. The set as set forth in claim 1, wherein the second grinding tool also has a non-grinding region.

3. The set as set forth in claim 2, wherein the non-grinding region is cylindrical with respect to the axis of rotation of the second grinding tool.

4. The set as set forth in claim 1, wherein the grinding region of the second grinding tool has a taper angle, with respect to an axis parallel to the axis of rotation of the second grinding tool, of between 0.014° and 0.039°.

5. The set as set forth in claim 1, wherein the grinding region of the first grinding tool is of a diameter of between 60 mm and 70 mm.

6. The set as set forth in claim 1, wherein the diameter of the grinding region of the second grinding tool increases in the axial direction of the second grinding tool over a length of the grinding region of the second grinding tool from the smallest diameter of the grinding region of the second grinding tool to a largest diameter of the grinding region of the second grinding tool; and a maximum difference between the smallest diameter of the grinding region of the second grinding tool and the largest diameter of the grinding region of the second grinding tool is between 50 μm and 110 μm.

7. The set as set forth in claim 1, wherein the grinding region of the first grinding tool and the grinding region of the second grinding tool are coated uniformly with a same grinding agent.

8. The set as set forth in claim 2, wherein a difference between the smallest diameter of the grinding region of the second grinding tool and a diameter of the non-grinding region of the second grinding tool is between 100 μm and 600 μm.

9. The set as set forth in claim 1, wherein the grinding region of the first grinding tool is of a length of between 40 mm and 60 mm, and the grinding region of the second grinding tool is of a length of between 80 mm and 100 mm.

10. The set as set forth in claim 1, wherein:

the first grinding tool has a central bore parallel to the axis of rotation of the first grinding tool; and the second grinding tool has a central bore parallel to the axis of rotation of the second grinding tool.

11. The set as set forth in claim 10, further comprising:

a plurality of passages extending between the central bore of the first grinding tool and the grinding region of the first grinding tool; and a plurality of passages extending between the central bore of the second grinding tool and the grinding region of the second grinding tool.

12. The set as set forth in claim 11, wherein:

the plurality of passages of the first grinding tool is arranged in a spiral form;

two adjacent passages of the plurality of passages of the first grinding tool are:

(i) arranged such that an angle between the two adjacent passages of the plurality of passages of the first grinding tool is between 40° and 60°; and (ii) spaced apart from each other in an axial direction of the first grinding tool by between 2 mm and 4 mm;

the plurality of passages of the second grinding tool is arranged in a spiral form; and two adjacent passages of the plurality of passages of the second grinding tool are:

(i) arranged such that an angle between the two adjacent passages of the plurality of passages of the second grinding tool is between 40° and 60°; and (ii) spaced apart from each other in the axial direction of the second grinding tool by between 2 mm and 4 mm.

13. The set as set forth in claim 1, wherein the flange includes at least one opening configured to receive a screw.

14. A CNC machine comprising:

a first grinding tool;

a second grinding tool; and a control program, wherein:

each of the first grinding tool and the second grinding tool is configured to machine an inside surface of a cylinder bore in a workpiece;

each of the first grinding tool and the second grinding tool has an axis of rotation;

the first grinding tool has a grinding region which is cylindrical with respect to the axis of rotation of the first grinding tool;

the second grinding tool has a grinding region which is conical with respect to the axis of rotation of the second grinding tool;

the first grinding tool and the second grinding tool are separate and distinct such that only one of the first grinding tool and the second grinding tool is configured to rotate at a time;

a diameter of the grinding region of the second grinding tool increases in an axial direction of the second grinding tool starting from a smallest diameter of the grinding region of the second grinding tool which corresponds to a diameter of the grinding region of the first grinding tool which is separate and distinct from the second grinding tool;

the second grinding tool has a free end and an opposite end, and the grinding region of the second grinding tool adjoins the free end on the second grinding tool;

the second grinding tool includes a flange configured to fix the second grinding tool to: (i) a machining head of a CNC machine; or (ii) an adaptor connected to the machining head of the CNC machine;

the flange is formed at the opposite end of the second grinding tool; and the control program is adapted to:

introduce at least one of the first grinding tool and the second grinding tool into the cylinder bore in the workpiece;

move the at least one of the first grinding tool and the second grinding tool to the inside surface of the cylinder bore in the workpiece;

guide the at least one of the first grinding tool and the second grinding tool at least once in a circle along the inside surface of the cylinder bore in the workpiece, in which case the at least one of the first grinding tool and the second grinding tool rotates about the axis of rotation of the at least one of the first grinding tool and the second grinding tool;

lift the at least one of the first grinding tool and the second grinding tool off the inside surface of the cylinder bore in the workpiece; and move the at least one of the first grinding tool and the second grinding tool out of the cylinder bore in the workpiece again.

15. A set comprising:

a first grinding tool; and a second grinding tool, wherein:

each of the first grinding tool and the second grinding tool is configured to machine an inside surface of a cylinder bore in a workpiece;

each of the first grinding tool and the second grinding tool has an axis of rotation;

the first grinding tool has a grinding region which is cylindrical with respect to the axis of rotation of the first grinding tool;

the second grinding tool has a grinding region which is conical with respect to the axis of rotation of the second grinding tool;

the first grinding tool and the second grinding tool are separate and distinct such that only one of the first grinding tool and the second grinding tool is configured to rotate at a time;

a diameter of the grinding region of the second grinding tool increases in an axial direction of the second grinding tool starting from a smallest diameter of the grinding region of the second grinding tool which corresponds to a diameter of the grinding region of the first grinding tool which is separate and distinct from the second grinding tool;

the first grinding tool has a central bore parallel to the axis of rotation of the first grinding tool;

the second grinding tool has a central bore parallel to the axis of rotation of the second grinding tool;

the first grinding tool includes a plurality of passages extending between the central bore of the first grinding tool and the grinding region of the first grinding tool;

the first grinding tool includes grooves in the grinding region of the first grinding tool;

the plurality of passages of the first grinding tool open into the grooves in the grinding region of the first grinding tool;

the second grinding tool includes a plurality of passages extending between the central bore of the second grinding tool and the grinding region of the second grinding tool;

the second grinding tool includes grooves in the grinding region of the second grinding tool; and the plurality of passages of the second grinding tool open into the grooves in the grinding region of the second grinding tool.

* * * * *